United States Patent [19]

Dixon

[11] 4,144,688

[45] Mar. 20, 1979

[54] FIRE RESISTANT SEALS

[75] Inventor: Bernard Dixon, Cambridge, England

[73] Assignee: Dixon International Limited, Cambridge, England

[21] Appl. No.: 785,129

[22] Filed: Apr. 6, 1977

[30] Foreign Application Priority Data

Apr. 13, 1976 [GB] United Kingdom ..... 15033/76

[51] Int. Cl.[2] ..... E16J 15/00; E06B 7/16

[52] U.S. Cl. ..... 52/232; 49/475; 49/504

[58] Field of Search ..... 49/475, 504; 52/309.4, 52/232

[56] References Cited

U.S. PATENT DOCUMENTS

| | | | |
|---|---|---|---|
| 3,566,541 | 3/1971 | Coulter | 49/475 |
| 3,964,214 | 6/1976 | Wendt | 52/232 X |
| 4,003,171 | 1/1977 | Mitchell | 49/408 |
| 4,045,930 | 9/1977 | Dixon | 49/475 X |

FOREIGN PATENT DOCUMENTS

| | | | |
|---|---|---|---|
| 93373 | 7/1962 | Denmark | 49/504 |
| 2286991 | 9/1975 | France | 49/475 |
| 104072 | 4/1964 | Norway | 49/504 |

*Primary Examiner*—Philip C. Kannan

*Attorney, Agent, or Firm*—Weingarten, Maxham & Schurgin

[57] ABSTRACT

A fire-resistant seal for application to a structure e.g. a door jamb, comprises a holder of substantially tubular form for securing to the structure, and a fire-barrier material, which swells under fire conditions, retained in the holder interior. To minimize dislodgment of the material by accident or tampering, the holder has a series of small external openings distributed therealong which communicate with its interior. The total flow area of the openings at the outer surface of the holder is less than the total imperforate area of the outer surface. The holder may be a hollow strip, and the openings confined to margins which extend along one face of the strip adjacent to opposite edges of the face, or the openings may be formed on opposite faces of the strip. The openings may be circular and/or rectangular at the outer surface of the holder and the distance between the centers of any two of the circular openings which are adjacent may be in the range of 4 times to 8 times half the sum of the diameters of the adjacent openings. The circular openings may be up to 3 mm. diameter and the rectangular openings 2 – 4 mm. wide and up to 10 mm. long. One or more internal baffles may be provided adjacent to the openings to protect the contents of the holder from dislodgment.

8 Claims, 2 Drawing Figures

FIRE RESISTANT SEALS

Figure 1:
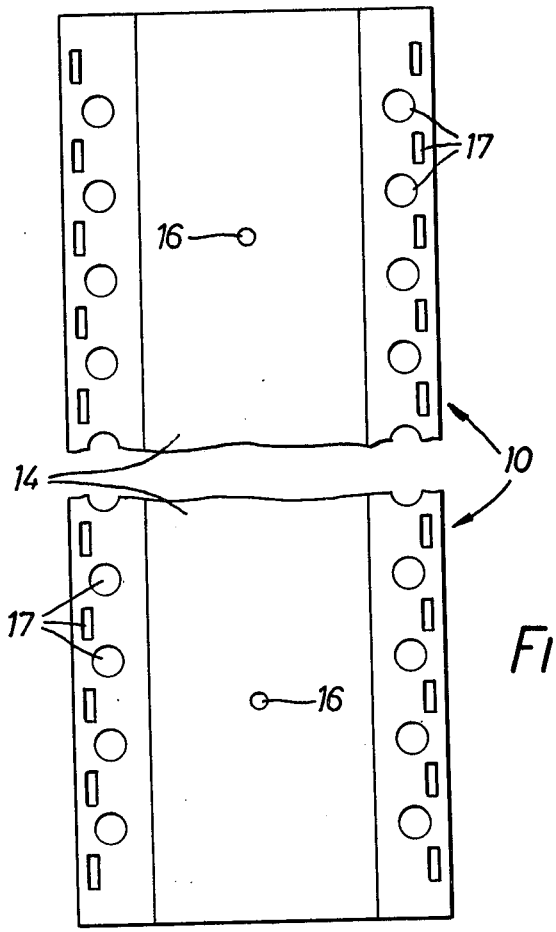

This invention relates to the application of material which swells when exposed to hot smoke or flame, and in the intumesced state constitutes a fire-resistant barrier. Such a material is referred to in this specification as fire-resistant barrier or intumescent material. This material has been used to form a fire-resistant barrier in gaps e.g. between a door and adjacent structure, e.g. the jamb, and correspondingly with respect to a window.

In our Complete Specification filed in respect of United States Application Ser. No. 616,003 we have described a fire-resistant seal for application to a structure comprising an elongate holder for securing thereto, and fire-resistant material, as above referred to, retained in the holder. The holder is preferably formed with an opening which extends throughout the length of the holder, through which opening the material effuses during intumescence. Alternatively a foil is provided which seals the opening; or, in place of the opening, a line of weakening is provided in the wall of the holder, the foil or weakened wall rupturing under pressure from the material when it swells under fire conditions.

With the object of improving protection for the material against tampering, for example by a probe pushed in through the opening, and improving mechanical support and retention of the material in the holder over time and against accidental blows after installation, we proposed in our United States Application Ser. No. 744,736, now U.S. Pat. No. 4,045,930 issued Sept. 6, 1977, a fire-resistant seal comprising a holder of substantially tubular form for securing to the structure, and a fire-resistant barrier material, which swells under fire conditions, retained in a chamber in the holder, the holder having an opening extending therealong, and a baffle surface extending within the holder and forming with the holder interior adjacent to the baffle surface a strait which extends between the opening and the chamber, the strait being co-extensive with the length of the opening.

With a similar objective we provide, according to the present invention, a seal comprising a holder of substantially tubular form for securing to a structure, a fire-barrier material, which swells under fire conditions, retained in the holder interior, the holder having a series of external openings distributed therealong and communicating with the holder interior, the total flow area of the openings at the outer surface of the holder being less than the total imperforate area of the outer surface. These openings enable the barrier material to exude from the holder when the material is intumescing, and should be distributed so that the exuded material, perhaps by running a little under gravity, will readily tend to form an uninterrupted barrier along the holder. The fact that the total flow area of the openings is less than the total imperforate area of the outer surface tends to safeguard the contents of the holder from dislodgment by tamperers or accidental blows.

Preferably the holder is in the form of a hollow strip, and the openings are confined to margins which extend along one face of the strip adjacent to opposite edges of the face. The openings may be formed on opposite faces of the strip. Furthermore it may be advisable to fix practical limits, for example to form the openings from 2mm. to 4mm. wide and up to 10mm. long, or up to 3mm. diameter, at the outer surface of the holder. The distance between centres of adjacent openings if circular may be in the range of 4 times to 8 times their diameters.

Figure 2:
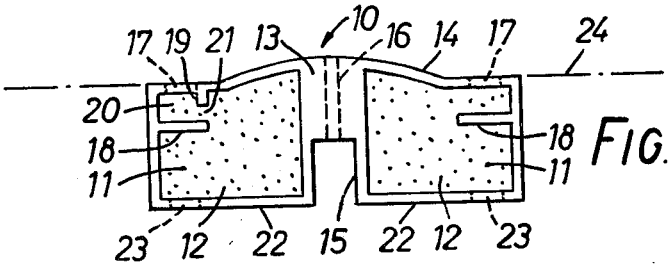

An example of seal which embodies the present invention will now be described with reference to the accompanying drawing, in which:

FIGS. 1 and 2 are plan and end views respectively of the seal.

Referring to FIGS. 1 and 2, the seal comprises an elongate holder 10, which may be a thin-walled aluminium extrusion. The holder contains a filling 11 of essentially fire-barrier material of the intumescent type.

The form of cross-section of the holder 10 may be designed to meet a particular need but generally speaking it may be of any convenient continuous tubular form. As shown, the holder comprises a hollow strip having two side-by-side non-communicating equal chambers 12, each containing the filling 11. The chambers are separated by a thick partition 13 extending from one face 14, referred to hereinafter as top face, to about half depth of the chambers, and are spaced thereafter by a groove 15 defined by opposing thin walls. The partition 13 is pierced by holes 16 which are spaced along the holder to receive fixing nails.

The top face 14 is rectangular and perforated in the margins which extend along the holder, adjacent to its longitudinal edges by two series of distributed openings 17, which may be of any convenient form e.g. circular and/or rectangular.

Each chamber 12 is preferably also formed with an internal horizontal baffle 18 which extends throughout the length of the holder below the openings 17, from which the baffle is spaced. The width of the baffle exceeds the width of the margin containing the openings 17. The purpose of the baffle is to afford some protection to the filling 11 from dislodgment by a probe which might be pushed through any of the openings by a tamperer. The closer the baffle is to the openings and the wider the baffle, the better the protection afforded the filling 11 in the chamber. However, the baffle should not be so close to the openings that the flow area cannot be utilised fully.

The protection described may be improved by providing a second internal but vertical baffle 19 which depends adjacent to the openings and between them and that part of the top area of the holder which is imperforate. One such vertical baffle 19, which extends throughout the length of the holder, is shown in the left hand chamber in FIG. 2 for illustration. It is preferred, however, to provide both the horizontal and vertical baffles 18, 19 in each chamber 12. The baffles 18, 19 define between themselves and the portion of the holder interior adjacent to the openings 17, namely at the top and side, an antechamber 20 which provides communication between the chamber 12 and the openings 17 by a slot 21 defined by inner or free extremities of the baffles 18, 19.

The bottom 22 of each chamber 12 may also be perforated by openings 23 which are distributed along the length of the holder. These openings 23 may be circular and/or rectangular.

The filling 11 preferably contains protective material for preventing moisture or other atmospheric attack on the intumescent material ingredient of the filling 11. Alternatively, or in addition, the openings 17, 23 are concealed by suitable sealant.

An example of fire barrier material which will intumesce in the range 150° C. to 250° C. is derived from the following mixture:

| | by weight | basic relative proportions |
|---|---|---|
| Melamine formaldehyde resin powder | 3800 g | 1 |
| Monammonium phosphate | 4200 g | 1 |
| Dicyandiamide | 2000 g | 1/2 |
| Pentaerythritol | 800 g | 1/5 |
| Plaster of Paris | 1100 g | 1/4 |
| Water dispersible polyvinyl acetate powder | 150 g | 1/25 |
| Wood flour (passing through 90 mesh) | 250 g | 1/20 |

The above mixture can be made up as a dry powder suitable for stocking, by intermixing the constituents in a dry powder state.

The above amounts or proportions are by no means critical: they can be varied widely.

We have found that it is practical to cut the holder first into one-meter lengths, and then pump the filling 11 into the holder chambers 12 as a slurry. Once the slurry has set, the openings 17, 23 are made. The circular openings are made by a gang of drills, and the rectangular openings are made by milling cutters.

Water (2400 g) is intermixed with the above dry mixture immediately before it is to be put into the holder. The mixture thus formed is a slurry which can be pumped into the holder chambers 12, the holder being held upright and the slurry introduced into the lower end of the holder. The holder should be loaded quickly with the slurry because of the setting action of the plaster of Paris which begins as soon as the water has been added. The slurry mixture is allowed to stand in the holder for 2 days at room temperature before making the openings 17, 23 in the holder, and thereafter matured at 40° C. for 24 hours. The holder containing the mixture is then ready for application as a fire-resistant seal.

A water absorption test carried out on the mature mixture or filling 11 showed it to increase in weight by about 7% after a 24-hour immersion. It is therefore advisable to waterproof the mixture as soon as the standing and maturing periods are complete in order to improve the shelf and service life of the fire-resistant seal produced. Waterproofing can be effected by coating the matured mixture or material in the holder with polyurethane resin.

The holder used is preferably of metal of high thermal conductivity such as aluminium, but may be of rigid plastics such as rigid PVC or ABS.

It may also be desirable in some instances to perforate not only the top and/or bottom faces of the rectangular-section holders illustrated but also the vertical longitudinal faces.

The total flow area of the openings at the surface of all faces must be less than the total area of the imperforate outer surface of the holder, the latter area being the sum of the top and bottom faces 14, 22, the vertical sides, and the surfaces of the groove 15. However the total area of the openings 17 at the outer surface of the top face 14 is preferably less than the total imperforate area of the top face.

The filled holder is usually applied to supporting structure, for example a wooden door frame, by inlaying in a prepared groove, the surface of the structure being indicated by the chain-line 24 in FIG. 2. The holder is fastened in place by nails introduced into the holes 16 from the top face 14 of the holder, which is exposed, and driven into the supporting structure.

In the presence of hot smoke or flame, heat reaches the filling 11 by conduction through the holder or by radiation. The filling 11 intumesces and effuses from the left hand chamber 12, through the slot 21 and antechamber 20, and thence through the openings 17. Effusion from the right hand chamber 12 is between the baffle 18 and the adjacent interior to the upper openings 17. Effusion from the lower openings 23 of each chamber may take place later and may force the holder from its original position in the groove. Dislodgment of the holder in this manner is of no disadvantage because of its siting in relation to the gap to be sealed.

I claim:

1. A fire-resistant seal for application to a structure, said seal comprising a holder of substantially tubular form for securing to the structure, said holder being in the form of a hollow strip wherein said openings are formed in opposite faces thereof, said holder defining an interchamber, a fire-barrier material which swells under fire conditions being retained in the chamber, the holder having a series of external openings distributed therealong and communicating with the interior chamber, the total flow area of the openings at the outer surface of the holder being less than the total imperforate area of said outer surface, a baffle extending within the holder throughout the length thereof and between the openings and the chamber.

2. A fire-resistant seal for application to a structure, said seal comprising a holder of substantially tubular form for securing to the structure, the holder defining an interior chamber, a fire-barrier material which swells under fire conditions being retained in the chamber, the holder having a series of external openings distributed therealong and communicating with the interior chamber, the total flow area of the openings at the outer surface of the holder being less than the total imperforate area of said outer surface, baffle means extending within the holder throughout the length thereof and between the openings and the chamber, said baffle means comprising first and second baffles having free extremities defining a slot, an antechamber being defined between the baffles and a portion of the wall of the holder in which portion at least some of said openings are provided, said antechamber providing communication between said openings and said chamber through said slot.

3. A fire-resistant seal according to claim 2, in which the first and second baffles have free extremities in the holder interior, said antechamber is defined between said baffles and a portion of the holder interior adjacent to the openings, said slot being defined by said free extremities of the baffles.

4. A fire-resistant seal for application to a structure, said seal comprising a holder of substantially tubular form for securing to the structure, the holder defining an interior chamber, a fire-barrier material which swells under fire conditions being retained in the chamber, the holder wall having a series of external spaced openings distributed therealong and communicating with the interior chamber, the total flow area of the openings at the outer surface of the holder being less than the total imperforate area of said outer surface, baffle means extending within the holder throughout the length thereof and between the openings and the chamber to protect against direct access externally through said openings to said interior chamber.

5. A fire-resistant seal according to claim 4, in which the holder is in the form of a hollow strip, and the openings are confined to margins which extend along one face of the strip adjacent to opposite edges of the face.

6. A fire-resistant seal according to claim 4, in which the openings at the outer surface of the holder comprise circular openings, and the distance between the centres of any two such openings which are adjacent is in the range of half the sum of their diameters.

7. A fire-resistant seal according to claim 4, in which the openings comprise circular openings of up to 3mm. diameter.

8. A fire-resistant seal according to claim 4, in which the openings comprise rectangular openings from 2mm. to 4mm. wide and up to 10mm. long.

* * * * *

UNITED STATES PATENT AND TRADEMARK OFFICE

CERTIFICATE OF CORRECTION

PATENT NO. : 4,144,688

DATED : March 20, 1979

INVENTOR(S) : Bernard Dixon

It is certified that error appears in the above-identified patent and that said Letters Patent are hereby corrected as shown below:

Column 5, line 7, "range of half the sum" should read --range of four times to eight times half the sum--.

Signed and Sealed this

*Eighteenth* Day of *March 1980*

[SEAL]

*Attest:*

SIDNEY A. DIAMOND

*Attesting Officer*

*Commissioner of Patents and Trademarks*